US011017793B2

(12) United States Patent
Shi et al.

(10) Patent No.: US 11,017,793 B2
(45) Date of Patent: May 25, 2021

(54) NUISANCE NOTIFICATION

(71) Applicant: Dolby Laboratories Licensing Corporation, San Francisco, CA (US)

(72) Inventors: Dong Shi, Shanghai (CN); David Gunawan, Sydney (AU); Glenn N. Dickins, Como (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 271 days.

(21) Appl. No.: 16/061,771

(22) PCT Filed: Dec. 14, 2016

(86) PCT No.: PCT/US2016/066557
§ 371 (c)(1),
(2) Date: Jun. 13, 2018

(87) PCT Pub. No.: WO2017/106281
PCT Pub. Date: Jun. 22, 2017

(65) Prior Publication Data

US 2018/0366136 A1 Dec. 20, 2018

Related U.S. Application Data

(60) Provisional application No. 62/269,208, filed on Dec. 18, 2015.

(30) Foreign Application Priority Data

Dec. 18, 2015 (CN) ..... 201510944432.2
Dec. 18, 2015 (EP) ..... 15201176

(51) Int. Cl.
*G10L 21/02* (2013.01)
*G10L 21/0232* (2013.01)
(Continued)

(52) U.S. Cl.
CPC ..... *G10L 21/0232* (2013.01); *G10L 25/18* (2013.01); *G10L 25/72* (2013.01); *G10L 21/02* (2013.01); *G10L 2021/02087* (2013.01)

(58) Field of Classification Search
None
See application file for complete search history.

(56) References Cited

U.S. PATENT DOCUMENTS 5,170,359 A * 12/1992 Sax ..... G10L 25/48 324/102
5,400,409 A * 3/1995 Linhard ..... G10L 21/0208 381/92
(Continued)

FOREIGN PATENT DOCUMENTS

EP 1622349 2/2006
EP 1672898 6/2006
(Continued)

OTHER PUBLICATIONS

Tiemounou, S. et al "Perception-Based Automatic Classification of Background Noise in Super-Wideband Telephony" J. Audio Engineering Society, vol. 62, No. 11, Nov. 2014, pp. 776-781.

*Primary Examiner* — Neeraj Sharma

(57) ABSTRACT

Example embodiments disclosed herein relate to audio signal processing. A method of indicating a presence of a nuisance in an audio signal is disclosed. The method includes determining a probability of the presence of the nuisance in a frame of the audio signal based on a feature of the audio signal, the nuisance representing an unwanted sound made by a user, in response to the probability of the presence of the nuisance exceeding a threshold, tracking the audio signal based on a metric over a plurality of frames following the frame, determining, based on the tracking, that the presence of the nuisance is to be indicated to the user, and in response to the determination, presenting to the user
(Continued)

a notification of the presence of the nuisance. Corresponding system and computer program product are also disclosed.

16 Claims, 3 Drawing Sheets

(51) Int. Cl.
*G10L 25/72* (2013.01)
*G10L 25/18* (2013.01)
*G10L 21/0208* (2013.01)

(56) References Cited

U.S. PATENT DOCUMENTS 6,339,758 B1 * 1/2002 Kanazawa ..... G10L 21/02 381/94.3
7,844,453 B2 * 11/2010 Hetherington ..... G10L 25/78 704/228
8,228,359 B2 7/2012 Hoory
8,693,703 B2 * 4/2014 Rung ..... G10L 21/0208 381/92
2006/0009980 A1 * 1/2006 Burke ..... G10L 15/30 704/270
2007/0136056 A1 * 6/2007 Moogi ..... G10L 21/0208 704/227
2009/0190769 A1 * 7/2009 Wang ..... H04R 3/005 381/66
2009/0285367 A1 11/2009 Diethorn
2011/0102540 A1 5/2011 Goyal
2012/0059649 A1 * 3/2012 Yamaguchi ..... H04R 3/02 704/226
2013/0051543 A1 * 2/2013 McDysan ..... H04M 3/568 379/202.01
2013/0073283 A1 * 3/2013 Yamabe ..... G10L 21/0216 704/226
2013/0249873 A1 * 9/2013 Zhang ..... G06F 3/0488 345/204
2015/0104049 A1 * 4/2015 Noda ..... G06F 3/012 381/303
2015/0221322 A1 * 8/2015 Iyengar ..... G10L 25/84 704/226
2015/0227194 A1 * 8/2015 Kubota ..... G06F 3/017 345/156
2015/0279386 A1 * 10/2015 Skoglund ..... G10L 25/84 704/208
2015/0347638 A1 * 12/2015 Patwari ..... G01S 15/89 703/1
2015/0348377 A1 * 12/2015 Kauffmann ..... G06F 3/04842 340/384.5
2015/0356975 A1 * 12/2015 Seo, II ..... G10L 19/008 381/17
2016/0212272 A1 * 7/2016 Srinivasan ..... H04N 21/439
2016/0225386 A1 * 8/2016 Tsujikawa ..... H04R 1/326
2017/0208407 A1 * 7/2017 Sapozhnykov ..... H04R 29/004

FOREIGN PATENT DOCUMENTS

EP 2247082 11/2010
EP 2779160 9/2014
WO 2007/118099 10/2007
WO 2009/014938 1/2009
WO 2014/043024 3/2014

* cited by examiner

NUISANCE NOTIFICATION

CROSS-REFERENCE TO RELATED APPLICATIONS

This application claims priority from U.S. Provisional Patent Application No. 62/269,208 filed 18 Dec. 2015; and Chinese Patent Application No. 201510944432.2 filed 18 Dec. 2015 and European Patent Application No. 15201176.3 filed 18 Dec. 2015 which are hereby incorporated by reference in its entirety.

TECHNOLOGY

Example embodiments disclosed herein generally relate to audio processing, and more specifically, to a method and system for indicating a presence of a nuisance in an audio signal.

BACKGROUND

In audio communication scenarios such as telecommunication or video conference, and the like, a user may unconsciously produce a nuisance. As used herein, the term "nuisance" refers to any unwanted sound captured in one or more microphones such as a user's breath, keyboard typing sounds, finger tapping sounds and the like. Such nuisances are generally conveyed by the telecommunication system and can be heard by other users. Sometimes the nuisance exists for a relatively long period of time which makes other users uncomfortable as well as degrade the overall communication among the users. However, unlike constant noises such as air conditioning noises, some nuisances are rapidly varying and therefore cannot be effectively removed by means of conventional audio noise suppression techniques. As a result, it is difficult to improve the user experience without correcting or ending the user behavior that is causing the unwanted noise.

SUMMARY

Example embodiments disclosed herein proposes a method and system for indicating a presence of a nuisance in an audio signal.

In one aspect, example embodiments disclosed herein provide a method of indicating a presence of a nuisance in an audio signal. The method includes determining a probability of the presence of the nuisance in a frame of the audio signal based on a feature of the audio signal, the nuisance representing an unwanted sound made by a user, in response to the probability of the presence of the nuisance exceeding a threshold, tracking the audio signal based on a metric over a plurality of frames following the frame, determining, based on the tracking, that the presence of the nuisance is to be indicated to the user, and in response to the determination, presenting to the user a notification of the presence of the nuisance.

In another aspect, example embodiments disclosed herein provide a system for indicating a presence of a nuisance in an audio signal. The system includes a probability determiner configured to determine a probability of the presence of the nuisance in a frame of the audio signal based on a feature of the audio signal, the nuisance representing an unwanted sound made by a user, a tracker configured to track, in response to the probability of the presence of the nuisance exceeding a threshold, the audio signal based on a metric over a plurality of frames following the frame, a notification determiner configured to determine, based on the tracking, that the presence of the nuisance is to be indicated to the user, and a notification presenter configured to present, in response to the determination, to the user a notification of the presence of the nuisance.

Through the following description, it would be appreciated that the presence of nuisance in the audio signal can be detected and the type of the audio signal can also be detected for determining whether the audio signal belongs to a nuisance and need to be indicated. The control can be configured to be intelligent and automatic. For example, in some cases when the type of the audio signal is detected to be a nuisance made by the user, the user will be notified so she/he is able to lower such a nuisance. In case that the type of the audio signal is detected to be a sound not made by the user (for example, made by vehicle passing by), or the nuisance made by the user does not last for a long time, the user is not to be notified.

DESCRIPTION OF DRAWINGS

Through the following detailed descriptions with reference to the accompanying drawings, the above and other objectives, features and advantages of the example embodiments disclosed herein will become more comprehensible. In the drawings, several example embodiments disclosed herein will be illustrated in an example and in a non-limiting manner, wherein.

Throughout the drawings, the same or corresponding reference symbols refer to the same or corresponding parts.

DESCRIPTION OF EXAMPLE EMBODIMENTS

Figure 1:
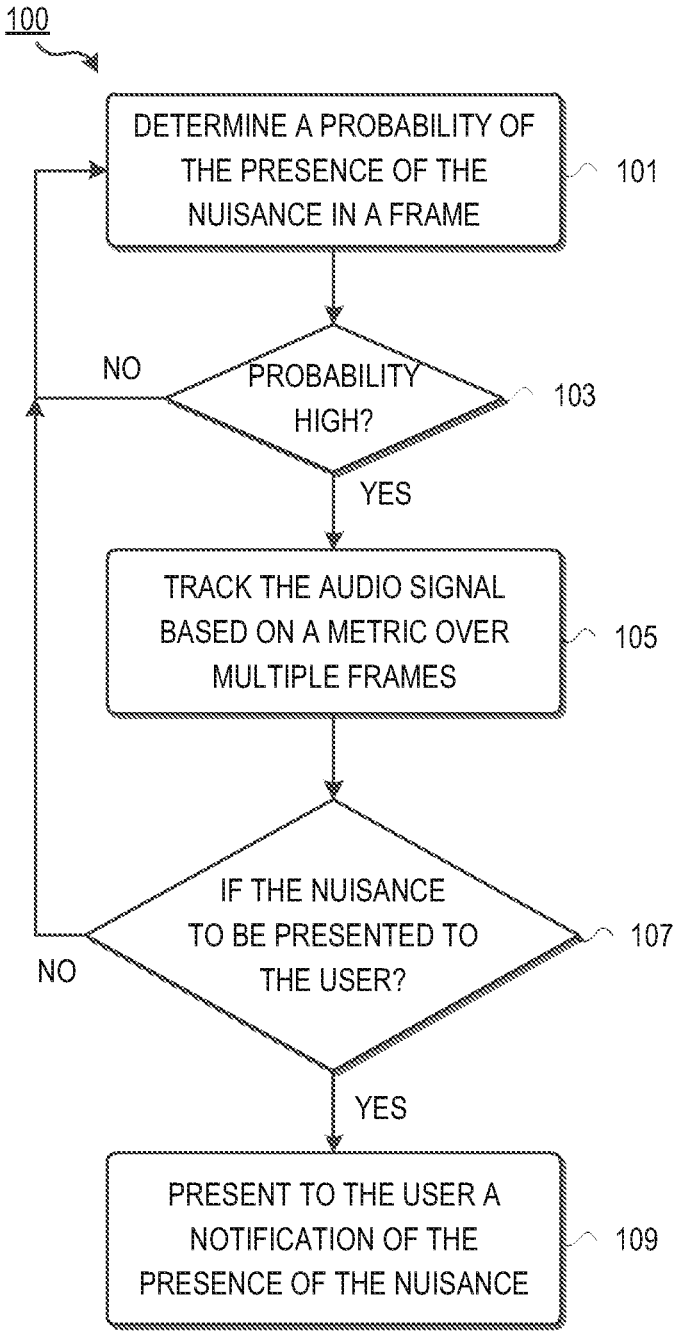
FIG. 1 illustrates a flowchart of a method of indicating a presence of a nuisance in an audio signal in accordance with an example embodiment.

Principles of the example embodiments disclosed herein will now be described with reference to various example embodiments illustrated in the drawings. It should be appreciated that the depiction of these embodiments is only to enable those skilled in the art to better understand and further implement the example embodiments disclosed herein, not intended for limiting the scope in any manner.

In a telecommunication or video conference environment, several parties may be involved. During a speech of one speaker, other listeners normally keep silent for a long period. However, in view of the fact that a lot of listeners may wear their headsets in a way that the microphones are placed very close to their mouths, unwanted sounds might be captured and conveyed. Examples of such unwanted sounds include, but are not limited to, breath sounds made by the listeners as they take breaths, keyboard typing sounds, unconscious finger tapping sounds, and any other noises produced in the environment of the participants. All these unwanted sounds are referred to as "nuisances" in the context herein.

In such cases, if the nuisance has lasted for a long period of time, other participants may be impacted by this sound and feel uncomfortable or interrupted by having to pause and point out and identify the source of the unwanted noise. However, the user making such a nuisance is usually unconscious of nuisance. For example, some users may place the microphone in a close distance to their mouths and the resulting breath sounds are very disturbing. Although some algorithms may be adopted to mitigate such breath sounds, it would be most effective to remove the nuisance by placing the microphones away from their mouths. Moreover, if the nuisance is a keyboard typing sound or other rapidly varying sound, it is hard to mitigate the nuisance without compromising the quality of the voice sound. Therefore, a proper indication to the user who is causing the unwanted nuisances is useful to let her/him realize the presence of the nuisance and then try to not make such sounds.

FIG. 1 illustrates a flowchart of a method 100 of indicating a presence of a nuisance in an audio signal in accordance with an example embodiment. In general, content of the frame can be classified as nuisance, background noise and voice. Nuisance, as defined above, is an unwanted sound in an environment of a user. Background noise can be regarded as a continuing noise which exists constantly such as air conditioning noises or engine noises. Background noise can be relatively easily detected and removed from the signal by the machine in an automatic way. Therefore, in accordance with embodiments disclosed herein, the background noise will not be classified as a nuisance to be indicated to the user. Voice is the sound including key information that users would like to receive.

In step 101, a probability of the presence of the nuisance in a frame of the audio signal is determined based on a feature of the audio signal. The determining step can be carried out frame by frame. The input audio signal can be captured by a microphone or any suitable audio capturing device. The input audio signal can be analyzed to obtain one or more features of the audio signal and the obtained feature or features are used to evaluate whether the frame can be classified as a nuisance. Since there are different ways of obtaining the features, some examples are listed and explained but there can be other features used for type detection. In one embodiment, the input audio signal is first transformed into the frequency domain and all of the features are calculated based on the frequency domain audio signal. Some example features will be described below. More broadly, the field of processing and detecting certain characteristics of the input as non-voice are well known in the art. As required in this disclosure such an approach must be able to perform a detection by observing the signal over time with appropriate latency, specificity and sensitivity.

In some example embodiment, the feature may include a spectral difference (SD) which indicates a difference in power between adjacent frequency bands. In one example embodiment, the SD may be determined by transforming the banded power values to logarithmic values after which these values are multiplied by a constant C (can be set to 10, for example) and squared. Each two adjacent squared results are subtracted each other for obtaining a differential value. Finally, the value of the SD is the median of the obtained differential values. This can be expressed as follows:

$$SD = \text{median}\left(\left(\left(\left(diff\left(C \cdot \log_{10}\begin{bmatrix} P_1 \\ P_2 \\ P_3 \\ \vdots \\ P_n \end{bmatrix}\right)\right)\right)^2\right) \tag{1}$$

where $P_1 \ldots P_n$ represent the input banded power of the current frame (vectors are denoted in bold text, it is assumed to have n bands), the operation diff( ) represents a function that calculates the difference in power of two adjacent bands, and median( ) represents a function that calculates the median value of an input sequence.

In one embodiment, the input audio signal has a frequency response ranging from a lower limit to an upper limit, which can be divided into several bands such as for example, 0 Hz to 300 Hz, 300 Hz to 1000 Hz and 1000 Hz to 4000 Hz. Each band may, for example, be evenly divided into a number of bins. The banding structure can be any conventional ones such as equivalent rectangular banding, bark scale and the like.

The operation log in Equation (1) above, is used to differentiate the values of the banded power more clearly but it is not limited, and thus in some other examples, the operation log can be omitted. After obtaining the differences, these differences can be squared but this operation is not necessary as well. In some other examples, the operation median can be replaced by taking average and so forth.

Alternatively, or in addition, a signal to noise ratio (SNR) may be used to indicate a ratio of power of the bands to power of a noise floor, which can be obtained by taking the mean value of all the ratios of the banded power to the banded noise floor and transforming the mean values to logarithmic values which are finally multiplied by a constant:

$$SNR = C \cdot \log_{10}\left(\text{mean}\begin{bmatrix} P_1/N_1 \\ P_2/N_2 \\ P_3/N_3 \\ \vdots \\ P_n/N_n \end{bmatrix}\right) \tag{2}$$

where n represents the number of bands, $N_1 \ldots N_n$ represent the banded power of the noise floor in the input audio signal, and the operation mean[ ] represents a function that calculates the average value (mean) of an input sequence. In some example embodiments, the constant C may be set to 10, for example.

$N_1 \ldots N_n$ can also be calculated using conventional methods such as minimum statistics or with prior knowledge of the noise spectra. Likewise, the operation log is used to differentiate the values more clearly but it is not limited, and thus in some other examples, the operation log can be omitted.

A spectral centroid (SC) indicates a centroid in power across the frequency range, which can be obtained by summing all the products of a probability for a frequency bin and the frequency for that bin:

$$SC = [prob_1 \quad prob_2 \quad \cdots \quad prob_m] \begin{bmatrix} binfreq_1 \\ binfreq_2 \\ \vdots \\ binfreq_m \end{bmatrix} \tag{3}$$

where m represents the number of bins, $prob_1 \ldots prob_m$ each represents the normalized power spectrum calculated as prob=PB/sum(PB), in which the operation sum( ) represents a summation and PB represents a vector form of the power of each frequency bin (there are totally m bins). $binfreq_1 \ldots binfreq_m$ represent vector forms of the actual frequencies of all the m bins. The operation mean( ) calculates the average value or mean of the power spectrum.

It has been found that in some cases the majority of energy of the audio signal containing a nuisance lies more in the low frequency range. Therefore, by Equation (3) a centroid can be obtained, and if the calculated centroid for a current frame of the audio signal lies more in the low frequency range, the content of that frame has a higher chance to be a nuisance.

A spectral variance (SV) is another useful feature that can be used to detect the nuisance. The SV indicates a width in power across the frequency range, which can be obtained by summing the product of the probability for a bin and a square of the difference between a frequency for that bin and the spectral centroid for that bin. The SV is further obtained by calculating the square root of the above summation. An example calculation of SV can be expressed as follows:

$$SV = \sqrt{[prob_1 \quad prob_2 \quad \cdots \quad prob_m] \begin{vmatrix} binfreq_1 - SC \\ binfreq_2 - SC \\ \vdots \\ binfreq_m - SC \end{vmatrix}^2} \tag{4}$$

Alternatively, or in addition, a power difference (PD) is used as a feature for detection of nuisance. The PD indicates a change in power of the frame and an adjacent frame along time line, which can be obtained by calculating the logarithmic value of the sum of the banded power values for the current frame and the logarithmic value of the sum of the banded power values for the previous frame. After the logarithmic values are each multiplied by a constant (can be set to 10, for example), the difference is calculated in absolute value as the PD. The above processes can be expressed as:

$$PD = \left| C \cdot \log_{10} \sum_{i=1}^{n} P_i - C \cdot \log_{10} \sum_{i=1}^{n} LP_i \right| \tag{5}$$

where $LP_1 \ldots LP_n$ represent the banded power for the previous frame. PD indicates how fast the energy changes from one frame to another. For nuisances, it is noted that the energy varies much slower than that of speech.

Another feature that can be used to detect the nuisance is band ratio (BR) which indicates a ratio of a first band and a second band of the bands, the first and second bands being adjacent to one another, which can be obtained by calculating ratios of one banded power to an adjacent banded power:

$$BR = \begin{bmatrix} P_2/P_1 \\ P_3/P_2 \\ \vdots \\ P_n/P_{n-1} \end{bmatrix} \tag{6}$$

In one embodiment, assuming there are bands span from 0 Hz to 300 Hz, 300 Hz to 1000 Hz and 1000 Hz to 4000 Hz, and only two BR will be calculated. It has been found that these ratios are useful for discriminating voiced frames from nuisances.

Then a probability of the presence of the nuisance is obtained based on the obtained one or more features. Example embodiments in this regard will be described in the following paragraphs. For example, if half of the features fulfill predetermined thresholds, the probability of the frame of the audio signal being a nuisance is 50%, or 0.5 out of 1. If all of the features fulfill the predetermined thresholds, the probability of the frame being a nuisance is very high, such as over 90%. More features being fulfilled result in a higher chance of the frame being a nuisance. As a result, the probability is compared with a predefined threshold (for example, 70% or 0.7) in step 103, so that the presence of the nuisance for the frame may be determined. If the probability is over the threshold, it means that the audio signal in this particular frame is very likely to be a nuisance, and the method proceeds to step 105. Otherwise, if the probability is below the predefined threshold, the audio signal in the frame is less likely to be a nuisance, and the audio signal will be analyzed in step 101 for a next frame. In one example, the audio signal will not be processed and a next frame will be analyzed if the frame is less likely to contain a nuisance.

In step 105, the audio signal is tracked based on one or more metrics over multiple frames following the frame that is analyzed in steps 101 and 103. That is, the probability of the presence of the nuisance will be determined for the subsequent multiple frames to monitor how the nuisance changes over time. In other words, in response to the presence of the nuisance being determined, the audio signal starting from that particular frame will be tracked for a period of time in step 105. The length of the period can be preset by a user if needed. Some example metrics will be described below.

In one embodiment, a metric of loudness which indicates how disrupting the nuisance sounds in an instantaneous manner is used. Loudness, denoted as l(t), can be calculated by using an instantaneous power of the input audio signal substracted by a reference power level and processing the result by some mathematical operations such as natural power and reciprocal operations:

$$l(t) = \frac{1}{1 + e^{-(p(t)-r)}} \tag{7}$$

where p(t) and r represent the instantaneous power of the audio signal and a pre-defined reference power value, respectively. It can be seen that l(t) increases as in input power goes up and is capped as value "1" (full loudness) as the instantaneous power p(t) goes to infinity.

In one embodiment, a metric of frequency which indicates how frequent the nuisance is over a predefined period of time (for example, several seconds) is used. Frequency, denoted as f(t), can be calculated as a weighted sum of an input nuisance classification result (assuming that a binary input of 1 means the frame contains a nuisance and a binary input of value 0 means the frame does not contain a nuisance) and a frequency value of the previous frame, where the sum of the weights can be equal to 1:

$$f(t)=\alpha f(t-1)+(1-\alpha)c(t) \tag{8}$$

where f(t), c(t) and a represent the frequency of the current time, nuisance classification result and a pre-defined smoothing factor, respectively. It is to be understood that the above calculation is only an example. N past classification results can be stored and the average rate of occurrences of the nuisance can be calculated.

In one embodiment, a metric of difficulty of the audio signal which indicates how difficult the system can mitigate the nuisance based on the type of the audio signal as classified earlier is used. The difficulty for mitigating the detected nuisance may be determined based on a lookup table. The lookup table records predetermined difficulties for mitigating one or more types of nuisances. Specifically, in some embodiments, the lookup table may record one or more types of nuisances which are not caused by users. Examples of such nuisances include vehicle horns in the street, telephone ringtones in the next room, and the like. The difficulty for removing those types of nuisances may be set high because usually the users are unable to mitigate the nuisances.

At least one of the metrics can contribute to the tracking step 105. Based on the tracking of the audio signal, in step 107, it is determined whether the nuisance notification is to be presented. In one embodiment, all the metrics are considered, meaning that only if the loudness, frequency and difficulty all fulfill predefined conditions the nuisance notification is determined to be presented to the user. For example, by monitoring the nuisance over some frames in step 105, it may be found that the nuisance disappears in later frames. That is, the nuisance does not exist any longer. In this case, the frequency of the nuisance is not high enough, and the nuisance is not necessary to be indicated to the user. In another possible scenario, the nuisance continues to exist over a longer period of time but is not loud enough to be considered as a disturbing source, meaning that the loudness is not large enough, and the nuisance is not necessary to be indicated to the user. It is noted that, in some other example embodiments, it is also possible not to use all of the metrics to determine if the nuisance needs to be reported to the user.

If it is determined in step 107 that the nuisance is not needed to be presented, the method 100 returns to step 101 where a next frame can be analyzed. Otherwise, if it is determined in step 107 that the nuisance should be presented, the method 100 proceeds to step 109, a notification of the presence of the nuisance is presented to the user. For example, a sound generated from the nuisance itself, a pre-recorded special sound and the like. Given the notification, the user can realize the nuisance he/she caused and avoid making the nuisance any more.

Figure 2:
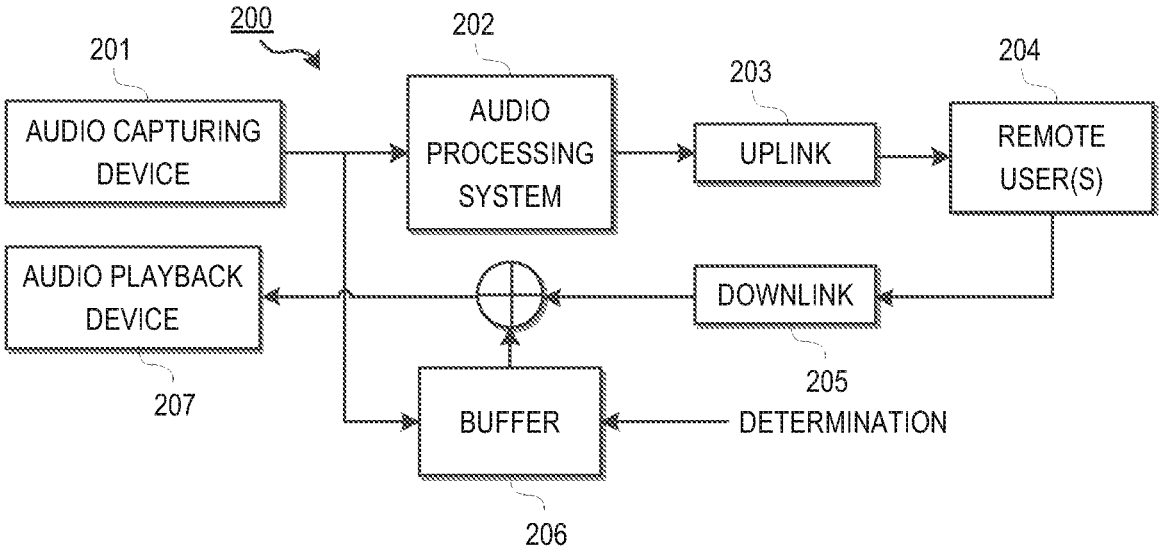
FIG. 2 illustrates a block diagram of a system used to present to the user the presence of the nuisance in accordance with an example embodiment.

FIG. 2 illustrates a block diagram of a system 200 used to present to the user the presence of the nuisance in accordance with an example embodiment. As shown, the input signal is captured in an audio capturing device 201 such as a microphone on a headset, and then is processed in an audio processing system 202 before being sent to one or more remote users or participants 204. The processed signal is sent to the remote user(s) 204 via an uplink channel 203. The processed audio signal will be heard by the remote user(s) 204 at other place(s). Meanwhile, the audio signal from the remote user(s) 204 is received via a downlink channel 205. The user would have heard the received audio signal without adding additional information. However, as shown in FIG. 2, if it is determined in step 107 as described above that the audio signal contains a nuisance to be presented to the user, the presence of such a nuisance can be actively presented to the user.

Specifically, a buffer 206 also records the captured audio signal from the audio capturing device 201 over time. In response to the nuisance being determined to be presented to the user whose result is input to the buffer 206, the recorded signal by the buffer 206 for the previous multiple frames may be mixed with the received signal from the remote user(s) 204 via the downlink channel 205. Finally, the mixed sound can be played by an audio playback device 207 so that the notification is heard by the user. It can be expected that whenever the user makes a nuisance such as a breath sound, she/he will hear her/his own breathing. It is very likely in this case that she/he will be aware of the annoyance of such a breath sound and then stop making such a nuisance or adjust the microphone position to mitigate the breath sound subsequently. It should be noted that the nuisance being mixed can be exactly the current signal captured by the microphone (for example, with some amplitude modification to further exacerbate the nuisance effect) or it can be further processed to sound a bit different (for example, by incorporating stereo or other audio effects).

In the example discussed above, the buffer 206 is used to provide a recorded nuisance for a number of previous frames so that the recorded nuisance can be mixed with an audio signal received from the remote user(s) 204. However, in some other examples, the buffer 206 is used to synthesize a nuisance which sounds further different from the recorded nuisance in order to easily draw the user's attention. Nuisance model parameters can be estimated by estimating parameters of linear model. For example, a number of nuisance sounds can be described by a linear model in which the signal is the output of a white noise going through a specific filter. Such a signal can be given by convolving a white noise signal with a linear filter, for example:

$$y(t) = w(t) + \sum_{i=1}^{N} h(i) \cdot y(t-i) \tag{9}$$

where y(t) represents the output of the filter (the nuisance), w(t) represents a white noise signal, h(i) represents the filter coefficients corresponding to one of various types for shaping the white noise into the nuisance, and N represents the number of coefficients, respectively.

In order to synthetize a nuisance, not all of the samples from the audio capturing device 201 to the buffer 206 are to be recorded. Instead, only the coefficients h(i) are required. There are some ways to estimate h(i), for example, by linear prediction (LP). Once the parameters are estimated, the model can be updated with the type of the audio signal given previously. Finally, the synthesized nuisance can be mixed with a regular audio signal for playback in the playback device 207. For the x-th nuisance type, the parameter $h_x$ can be updated by a weighted sum of the parameter itself and an estimated model parameter, where a sum of the weights is equal to 1:

$$h_x=\beta h_x+(1-\beta)\,\widehat{h_x} \tag{10}$$

where β represents a predefined constant ranging from 0 to 1, and $\widehat{h_x}$ represents the estimated model parameters.

Although it is discussed that a recorded nuisance and a synthesized nuisance can be used to present a notification to the user, in a situation, a pre-recorded sound may be played in case that the nuisance is determined to be presented to the user. The form of notification is not to be limited, as long as the notification is rapidly noticed and associated by the user as a condition where they are imparting a signal into the conference which may be unintentional and thus the presence of nuisance.

Figure 3:
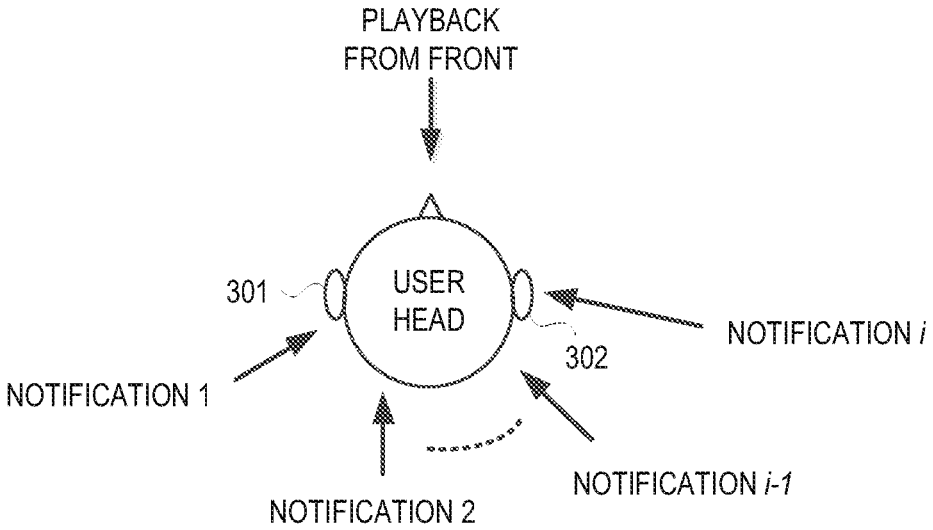
FIG. 3 illustrates an example of spatial notification with regard to the user's head in accordance with an example embodiment.

FIG. 3 illustrates an example of spatial notification with regard to the user's head in accordance with an example embodiment. For playback devices that can provide spatial output, e.g., stereo headset, the user can be notified in a spatial way by convolving a mono sound with two impulse responses representing the transfer function between the sound and the ears from a particular angle. In other words, a modification on phase or amplitude is applied to the audio signals for a left channel 301 and a right channel 302, using the recorded or synthesized nuisance or other effects. Specifically, the nuisance signal can be played as if it comes from the back of the user but not from the front of the user. In some example embodiments, a head related transfer function (HRTF) can be used for achieving the above effect. The HRTF is actually a bunch of impulse responses, each pair representing the transfer function of a particular angle in relation to the right/left ears. In most cases, the playback system renders speeches from other talkers in front of the user, and thus an audio signal with its phase shifted can be heard differently, which is usually noticeable by the user. Taking advantage of this fact, the notification sounds can be rendered further away from the normal spatial cues such as the back and the sides of the user, as can be shown in FIG. 3 as notification 1 to i. It is also possible that different types of nuisances being played out from different angles or the nuisance signal is further processed to make the sound appears more diffused and widened, as if it comes from everywhere. These effects may further increase differentiability from the normal nuisances and speeches from other users on the call.

By hearing a notification such as the types discussed above, a user is able to be aware of her/his own nuisance and then correct the placement of the microphone or stop making the nuisance such as typing the keyboard heavily. The notification is especially useful because the nuisance can be removed effectively without compromising the audio quality which is normally degraded by other mitigation methods. If the notification is properly selected, the user may realize the nuisance in a short time, and contribute to a better experience of the call.

Figure 4:
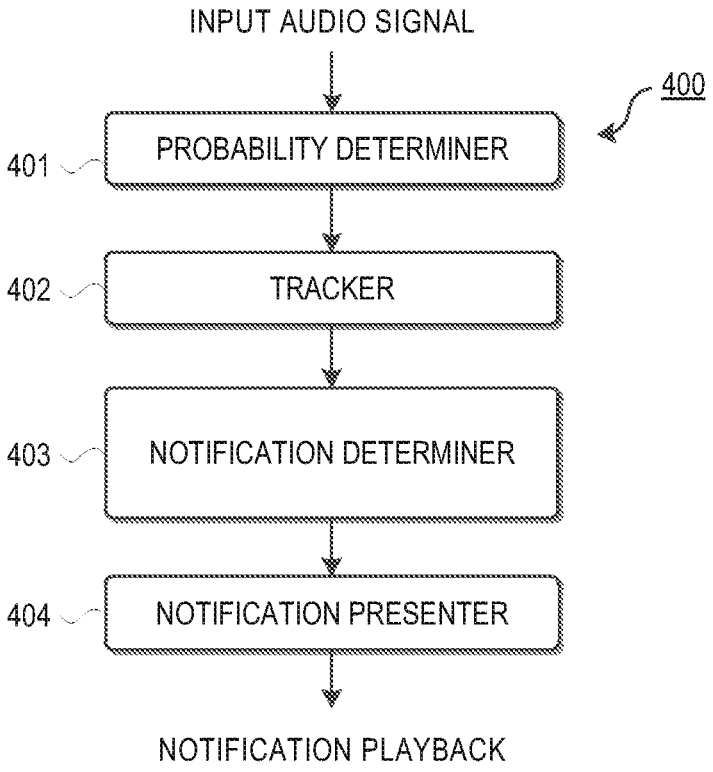
FIG. 4 illustrates a system for indicating the presence of the nuisance in accordance with an example embodiment.

FIG. 4 illustrates a system 400 for indicating a presence of a nuisance in an audio signal in accordance with an example embodiment. As shown, the system 400 includes a probability determiner 401 configured to determine a probability of the presence of the nuisance in a frame of the audio signal based on a feature of the audio signal, the nuisance representing an unwanted sound in an environment where a user is located, a tracker 402 configured to track, in response to the probability of the presence of the nuisance exceeding a threshold, the audio signal based on a metric over a plurality of frames following the frame; a notification determiner 403 configured to determine, based on the tracking, that the presence of the nuisance is to be indicated to the user, and a notification presenter 404 configured to present, in response to the determination, to the user a notification of the presence of the nuisance.

In an example embodiment, the probability determiner 401 may include: a feature extractor configured to extract the feature from the audio signal, and a type determiner configured to determine a type of the audio signal in the frame based on the extracted feature.

In a further example embodiment, the feature may be selected from a group consisting of: a spectral difference indicating a difference in power between adjacent bands, a signal to noise ratio (SNR) indicating a ratio of power of the bands to power of a noise floor, a spectral centroid indicating a centroid in power across the frequency range, a spectral variance indicating a width in power across the frequency range, a power difference indicating a change in power of the frame and an adjacent frame, and a band ratio indicating a ratio of a first band and a second band of the bands, the first and second bands being adjacent to one another.

In yet another example embodiment, the metric may selected from a group consisting of: loudness of the audio signal, a frequency that the probability of the presence of the nuisance exceeds the threshold over the plurality of frames, and a difficulty of mitigating the nuisance.

In yet another example embodiment, the difficulty may be determined at least in part based on the type of the audio signal.

In one another example embodiment, the notification presenter 404 may be further configured to present to the user by one of the following: playing back the nuisance made by the user recorded in a buffer, playing back a synthetic sound by combining a white noise and a linear filter for shaping the white noise into the nuisance, or playing back a pre-recorded sound.

In yet another example embodiment, the notification may be presented by being rendered in a predefined spatial position.

For the sake of clarity, some optional components of the system 400 are not shown in FIG. 4. However, it should be appreciated that the features as described above with reference to FIGS. 1-3 are all applicable to the system 400. Moreover, the components of the system 400 may be a hardware module or a software unit module. For example, in some embodiments, the system 400 may be implemented partially or completely with software and/or firmware, for example, implemented as a computer program product embodied in a computer readable medium. Alternatively or additionally, the system 400 may be implemented partially or completely based on hardware, for example, as an integrated circuit (IC), an application-specific integrated circuit (ASIC), a system on chip (SOC), a field programmable gate array (FPGA), and so forth. The scope of the present disclosure is not limited in this regard.

Figure 5:
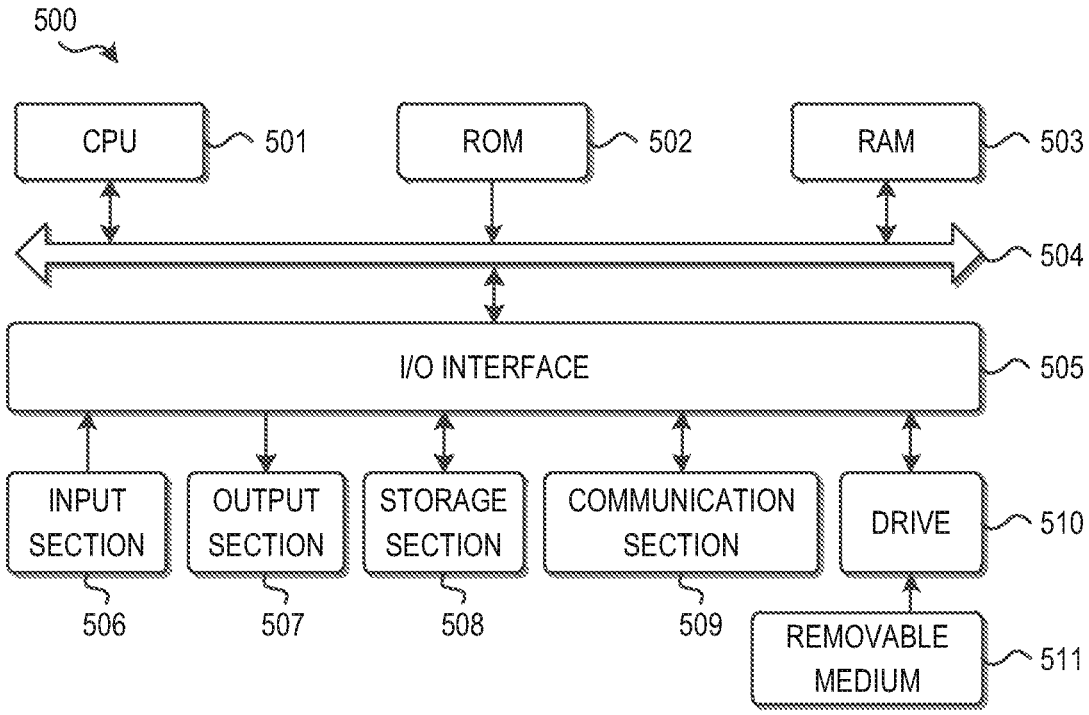
FIG. 5 illustrates a block diagram of an example computer system suitable for the implementing example embodiments disclosed herein.

FIG. 5 shows a block diagram of an example computer system 500 suitable for implementing example embodiments disclosed herein. As shown, the computer system 500 comprises a central processing unit (CPU) 501 which is capable of performing various processes in accordance with a program recorded in a read only memory (ROM) 502 or a program loaded from a storage section 508 to a random access memory (RAM) 503. In the RAM 503, data required when the CPU 501 performs the various processes or the like is also stored as required. The CPU 501, the ROM 502 and the RAM 503 are connected to one another via a bus 504. An input/output (I/O) interface 505 is also connected to the bus 504.

The following components are connected to the I/O interface 505: an input section 506 including a keyboard, a mouse, or the like; an output section 507 including a display, such as a cathode ray tube (CRT), a liquid crystal display (LCD), or the like, and a speaker or the like; the storage section 508 including a hard disk or the like; and a communication section 509 including a network interface card such as a LAN card, a modem, or the like. The communication section 509 performs a communication process via the network such as the internet. A drive 510 is also connected to the I/O interface 505 as required. A removable medium 511, such as a magnetic disk, an optical disk, a magneto-optical disk, a semiconductor memory, or the like, is mounted on the drive 510 as required, so that a computer program read therefrom is installed into the storage section 508 as required.

Specifically, in accordance with the example embodiments disclosed herein, the processes described above with reference to FIGS. 1-3 may be implemented as computer software programs. For example, example embodiments disclosed herein comprise a computer program product including a computer program tangibly embodied on a machine readable medium, the computer program including program code for performing methods 100. In such embodiments, the computer program may be downloaded and mounted from the network via the communication section 509, and/or installed from the removable medium 511.

Generally speaking, various example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments disclosed herein are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, example embodiments disclosed herein include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include, but not limited to, an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the present disclosure may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server or distributed among one or more remote computers or servers.

Further, while operations are depicted in a particular order, this should not be understood as requiring that such operations be performed in the particular order shown or in a sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any disclosure or of what may be claimed, but rather as descriptions of features that may be specific to particular embodiments of particular disclosures. Certain features that are described in this specification in the context of separate embodiments can also be implemented in combination in a single embodiment. Conversely, various features that are described in the context of a single embodiment can also be implemented in multiple embodiments separately or in any suitable subcombination.

Various modifications, adaptations to the foregoing example embodiments of this disclosure may become apparent to those skilled in the relevant arts in view of the foregoing description, when read in conjunction with the accompanying drawings. Any and all modifications will still fall within the scope of the non-limiting and example embodiments of this disclosure. Furthermore, other example embodiments set forth herein will come to mind of one skilled in the art to which these embodiments pertain to having the benefit of the teachings presented in the foregoing descriptions and the drawings.

Various aspects of the present invention may be appreciated from the following enumerated example embodiments (EEEs):

EEE 1. A method of indicating a presence of a nuisance in an audio signal, comprising:

determining a probability of the presence of the nuisance in a frame of the audio signal based on a feature of the audio signal, the nuisance representing an unwanted sound in an environment where a user is located;

in response to the probability of the presence of the nuisance exceeding a threshold, tracking the audio signal based on a metric over a plurality of frames following the frame;

determining, based on the tracking, that the presence of the nuisance is to be indicated to the user; and in response to the determination, presenting to the user a notification of the presence of the nuisance.

EEE 2. The method according to EEE 1, wherein determining the probability of the presence of the nuisance comprises:

extracting the feature from the audio signal; and determining a type of the audio signal in the frame based on the extracted feature.

EEE 3. The method according to EEE 2, wherein the feature is selected from a group consisting of:

a spectral difference indicating a difference in power between adjacent bands;

a signal to noise ratio (SNR) indicating a ratio of power of the bands to power of a noise floor;

a spectral centroid indicating a centroid in power across the frequency range;

a spectral variance indicating a width in power across the frequency range;

a power difference indicating a change in power of the frame and an adjacent frame; and a band ratio indicating a ratio of a first band and a second band of the bands, the first and second bands being adjacent to one another.

EEE 4. The method according to any of EEEs 1 to 3, wherein the metric is selected from a group consisting of:

loudness of the audio signal;

a frequency that the probability of the presence of the nuisance exceeds the threshold over the plurality of frames; and a difficulty of mitigating the nuisance.

EEE 5. The method according to EEE 4, wherein the difficulty is determined at least in part based on the type of the audio signal.

EEE 6. The method according to EEE 5, wherein the difficulty is obtained from a lookup table recording predetermined difficulties for mitigating one or more types of nuisances.

EEE 7. The method according to any of EEEs 1 to 6, wherein presenting the notification comprises at least one of:

playing back the nuisance made by the user;

playing back a synthetic sound by combining a white noise and a linear filter for shaping the white noise into the nuisance; or playing back a pre-recorded sound.

EEE 8. The method according to any of EEEs 1 to 7, wherein the notification is presented by being rendered in a predefined spatial position.

EEE 9. A system for indicating a presence of a nuisance in an audio signal, including:

a probability determiner configured to determine a probability of the presence of the nuisance in a frame of the audio signal based on a feature of the audio signal, the nuisance representing an unwanted sound in an environment where a user is located;

a tracker configured to track, in response to the probability of the presence of the nuisance exceeding a threshold, the audio signal based on a metric over a plurality of frames following the frame;

a notification determiner configured to determine, based on the tracking, that the presence of the nuisance is to be indicated to the user; and a notification presenter configured to present, in response to the determination, to the user a notification of the presence of the nuisance.

EEE 10. The system according to EEE 9, wherein the probability determiner comprises:

a feature extractor configured to extract the feature from the audio signal; and a type determiner configured to determine a type of the audio signal in the frame based on the extracted feature.

EEE 11. The system according to EEE 10, wherein the feature is selected from a group consisting of:

a spectral difference indicating a difference in power between adjacent bands;

a signal to noise ratio (SNR) indicating a ratio of power of the bands to power of a noise floor;

a spectral centroid indicating a centroid in power across the frequency range;

a spectral variance indicating a width in power across the frequency range;

a power difference indicating a change in power of the frame and an adjacent frame; and a band ratio indicating a ratio of a first band and a second band of the bands, the first and second bands being adjacent to one another.

EEE 12. The system according to any of EEEs 9 to 11, wherein the metric is selected from a group consisting of:

loudness of the audio signal;

a frequency that the probability of the presence of the nuisance exceeds the threshold over the plurality of frames; and a difficulty of mitigating the nuisance.

EEE 13. The system according to EEE 12, wherein the difficulty is determined at least in part based on the type of the audio signal.

EEE 14. The system according to EEE 13, wherein the difficulty is obtained from a lookup table recording predetermined difficulties for mitigating one or more types of nuisances.

EEE 15. The system according to any of EEEs 9 to 14, wherein the notification presenter is further configured to present to the user by one of the following:

playing back the nuisance made by the user;

playing back a synthetic sound by combining a white noise and a linear filter for shaping the white noise into the nuisance; or playing back a pre-recorded sound.

EEE 16. The system according to any of EEEs 9 to 15, wherein the notification is presented by being rendered in a predefined spatial position.

EEE 17. A device comprising:

a processor; and a memory storing instructions thereon, the processor, when executing the instructions, being configured to carry out the method according to any of EEEs 1-8.

EEE 18. A computer program product for indicating a presence of a nuisance in an audio signal, the computer program product being tangibly stored on a non-transient computer-readable medium and comprising machine executable instructions which, when executed, cause the machine to perform steps of the method according to any of EEEs 1 to 8.

The invention claimed is:

1. A method of indicating a presence of a nuisance in an uplink audio signal, comprising:

transmitting the uplink audio signal from a first environment where a user is located to a second environment;

receiving a downlink audio signal from the second environment to the first environment;

determining a probability of the presence of the nuisance in a frame of the uplink audio signal based on a feature of the uplink audio signal, the nuisance representing an unwanted sound in the first environment where the user is located;

in response to the probability of the presence of the nuisance exceeding a threshold, tracking the uplink audio signal based on a metric over a plurality of frames following the frame;

determining, based on the tracking, that the presence of the nuisance is to be indicated to the user; and in response to the determination, presenting to the user a notification of the presence of the nuisance, wherein the downlink audio signal is outputted as sound in a first spatial position and the notification is outputted as sound in a second spatial position, wherein the first spatial position is in front of the user, and wherein the notification is outputted as sound in the second spatial position by at least one of modifying a phase of the notification, and applying a head related transfer function to the notification.

2. The method according to claim 1, wherein determining the probability of the presence of the nuisance comprises:

extracting the feature from the uplink audio signal; and determining a type of the uplink audio signal in the frame based on the extracted feature.

3. The method according to claim 2, wherein the feature is selected from a group consisting of:

a spectral difference indicating a difference in power between adjacent bands;

a signal to noise ratio (SNR) indicating a ratio of power of the bands to power of a noise floor;

a spectral centroid indicating a centroid in power across the frequency range;

a spectral variance indicating a width in power across the frequency range;

a power difference indicating a change in power of the frame and an adjacent frame; and a band ratio indicating a ratio of a first band and a second band of the bands, the first and second bands being adjacent to one another.

4. The method according to claim 1, wherein the metric is selected from a group consisting of:

loudness of the uplink audio signal;

a frequency that the probability of the presence of the nuisance exceeds the threshold over the plurality of frames; and a difficulty of mitigating the nuisance.

5. The method according to claim 4, wherein the difficulty is determined at least in part based on the type of the uplink audio signal.

6. The method according to claim 5, wherein the difficulty is obtained from a lookup table recording predetermined difficulties for mitigating one or more types of nuisances.

7. The method according to claim 1, wherein presenting the notification comprises at least one of:

playing back the nuisance made by the user;

playing back a synthetic sound by combining a white noise and a linear filter for shaping the white noise into the nuisance; or playing back a pre-recorded sound.

8. A system for indicating a presence of a nuisance in an audio signal, including:

an uplink channel configured to transmit the uplink audio signal from a first environment where a user is located to a second environment;

a downlink channel configured to receive a downlink audio signal from the second environment to the first environment;

a probability determiner configured to determine a probability of the presence of the nuisance in a frame of the uplink audio signal based on a feature of the uplink audio signal, the nuisance representing an unwanted sound in the first environment where the user is located;

a tracker configured to track, in response to the probability of the presence of the nuisance exceeding a threshold, the uplink audio signal based on a metric over a plurality of frames following the frame;

a notification determiner configured to determine, based on the tracking, that the presence of the nuisance is to be indicated to the user; and a notification presenter configured to present, in response to the determination, to the user a notification of the presence of the nuisance, wherein the downlink audio signal is outputted as sound in a first spatial position and the notification is outputted as sound in a second spatial position, wherein the first spatial position is in front of the user, and wherein the notification is outputted as sound in the second spatial position by at least one of modifying a phase of the notification, and applying a head related transfer function to the notification.

9. The system according to claim 8, wherein the probability determiner comprises:

a feature extractor configured to extract the feature from the uplink audio signal; and a type determiner configured to determine a type of the uplink audio signal in the frame based on the extracted feature.

10. The system according to claim 9, wherein the feature is selected from a group consisting of:

a spectral difference indicating a difference in power between adjacent bands;

a signal to noise ratio (SNR) indicating a ratio of power of the bands to power of a noise floor;

a spectral centroid indicating a centroid in power across the frequency range;

a spectral variance indicating a width in power across the frequency range;

a power difference indicating a change in power of the frame and an adjacent frame; and a band ratio indicating a ratio of a first band and a second band of the bands, the first and second bands being adjacent to one another.

11. The system according to claim 8, wherein the metric is selected from a group consisting of:

loudness of the uplink audio signal;

a frequency that the probability of the presence of the nuisance exceeds the threshold over the plurality of frames; and a difficulty of mitigating the nuisance.

12. The system according to claim 11, wherein the difficulty is determined at least in part based on the type of the uplink audio signal.

13. The system according to claim 12, wherein the difficulty is obtained from a lookup table recording predetermined difficulties for mitigating one or more types of nuisances.

14. The system according to claim 8, wherein the notification presenter is further configured to present to the user by one of the following:

playing back the nuisance made by the user;

playing back a synthetic sound by combining a white noise and a linear filter for shaping the white noise into the nuisance; or playing back a pre-recorded sound.

15. The method according to claim 1, wherein the second spatial position is in back of the user.

16. The system according to claim 8, further including:

a stereo headset that is configured to output the downlink audio signal as sound in the first spatial position and to output the notification as sound in the second spatial position.

* * * * *